United States Patent [19]

Trenschel et al.

[11] 4,058,263

[45] Nov. 15, 1977

[54] ADJUSTABLE PINTLE SPRAY MANIFOLD ASSEMBLY

[75] Inventors: Donald R. Trenschel, Lake Park; Frederick G. Eitel, North Palm Beach, both of Fla.

[73] Assignee: The United States of America as represented by the Secretary of the Air Force, Washington, D.C.

[21] Appl. No.: 714,414

[22] Filed: Aug. 16, 1976

[51] Int. Cl.[2] ..... B05B 1/30; B05B 1/14

[52] U.S. Cl. ..... 239/551; 239/582; 239/600

[58] Field of Search ..... 239/533.13, 533.14, 239/550, 551, 569, 580, 581, 582, 600

[56] References Cited

U.S. PATENT DOCUMENTS

| | | | |
|---|---|---|---|
| 1,155,631 | 10/1915 | White | 239/582 |
| 2,989,250 | 6/1961 | Simon | 239/582 X |
| 3,827,638 | 8/1974 | Halvorsen | 239/582 X |

*Primary Examiner*—Evon C. Blunk
*Assistant Examiner*—Andres Kashnikow
*Attorney, Agent, or Firm*—Joseph E. Rusz; Arsen Tashjian

[57] ABSTRACT

An adjustable fluid flow and spray control for use in conjunction with a manifold. The rate of flow of a fluid, and the rate of spraying of the fluid, are controlled by moving a pintle, instead of further deforming the manifold, as is conventionally done.

6 Claims, 2 Drawing Figures

ADJUSTABLE PINTLE SPRAY MANIFOLD ASSEMBLY

STATEMENT OF GOVERNMENT INTEREST

The invention described herein may be manufactured and used by or for the Government for governmental purposes without the payment of any royalty thereon.

BACKGROUND OF THE INVENTION

This invention relates to the spraying art and, more particularly, to a spray manifold in and through which the quantity and rate of flow (or, more accurately, the spray) of fluid is easily adjustable by moving a pintle.

Spray manifolds and pintles are well known. Equally well known are the facts: that the desired flow of a fluid into and through a spray manifold is conventionally adjusted by deforming the manifold; and, that any exposure of the deformed manifold to any hot operating environment adversely alters the deformation and, thus, the already-adjusted flow through the manifold, thereby requiring further adjustment of the manifold.

We have eliminated this re-adjustment problem with a uniquely stuctured spray manifold, wherein the desired flow into and through the manifold is very easily adjusted and maintained by moving a pintle, instead of further deforming the manifold, as is done traditionally.

Thereby, we have significantly advanced the state-of-the-art.

SUMMARY OF THE INVENTION

This invention pertains to an adjustable pintle spray manifold.

An object of this invention is to permit the effective use of a spray manifold in a hot operating environment without the prior art necessity of re-adjusting a spray manifold (or, more accurately, the previously adjusted and deformed manifold) to permit continued flow of the desired quantity and at the desired rate into and through the manifold.

Another object of this invention is to teach the structure of a unique spray manifold which, in addition to its other fundamentally advantageous features, is simple in structure, is very easy to adjust, and is very economical to manufacture.

Still another object of this invention is to teach a novel method of manufacturing the inventive adjustable pintle spray manifold.

These objects, and other and related objects, of this invention will become readily apparent after a consideration of the description of the invention, coupled with reference to the Figures of the drawings.

DESCRIPTION OF THE INVENTIVE METHOD

The very basic and fundamental steps of our inventive method of manufacturing and assembling our adjustable pintle spray manifold assembly comprises, essentially, eight steps.

As a preliminary matter it is to be assumed that we have already manufactured: a manifold having an upper surface and a lower surface; a pintle having an upper portion with an end shaped in a converging-diverging configuration, and a threaded lower portion; a pintle support having an upper portion, a lower portion with a base surface, and a passageway extending through the upper portion, the lower portion, and the base surface of the pintle support; and, a nut complimentarily threaded to accept, engage with, and releasably hold the threaded lower portion of the pintle.

Figure 1:
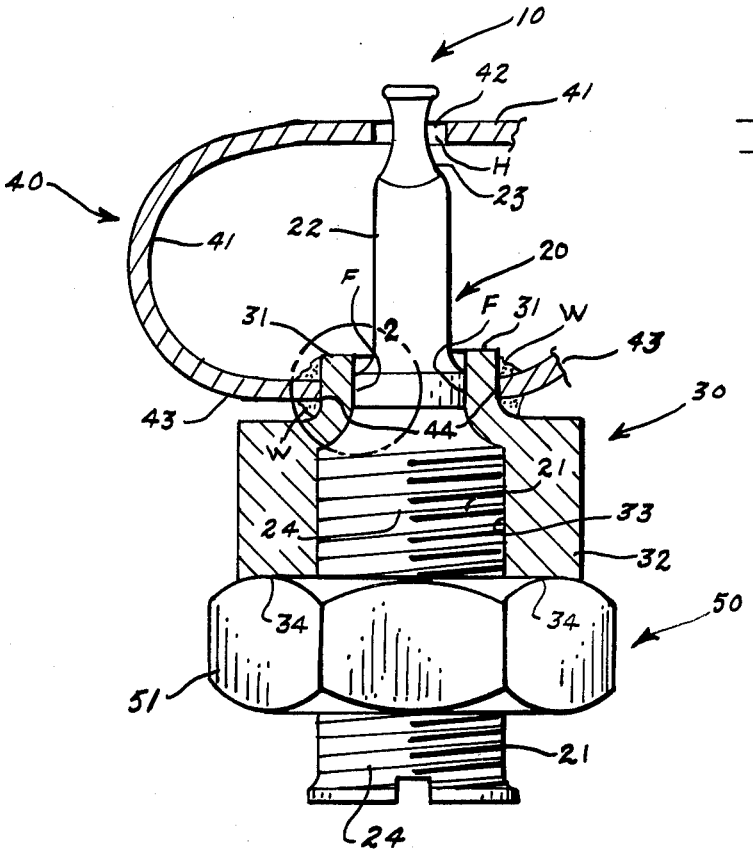
FIG. 1 is a side elevation view, in simplified schematic form and partially in cross section, of a preferred embodiment of our inventive adjustable pintle spray manifold.

Now, with reference to FIG. 1 of the drawings wherein one embodiment 10 of our invention is shown in completed form, the steps of our method are:

Firstly, we form an opening 44 in and through the lower surface 43 of the manifold 40.

Next, we affix the manifold 40, at the opening 44, to the upper portion 31 of the pintle support 30, thereby completely closing this opening 44 in the manifold and integrating the manifold 40 and the pintle support 30.

Then, we heat treat the affixed and integrated manifold 40 and pintle support 30, thereby relieving any stresses in the affixed and integrated manifold and pintle support.

Next, we thread the passageway 33 of the pintle support 30 to accept, engage with, and releasably hold the threaded lower portion 21 of the pintle 20.

Then, we form an opening 42 in and through the upper surface 41 of the manifold 40.

Next, we insert and engage the pintle 20 into the threaded passageway 33 of the pintle support 30. Thereby, the upper portion 22 of the pintle 20 is disposed in the manifold 40, with the configurated end 23 of the upper portion of the pintle in the opening 42 in the upper surface 41 of the manifold 40, and with part of the threaded lower portion 21 of the pintle 20 extending beyond and below the base 34 of the pintle support 30.

Then, we adjust the upward position of the configurated end 23 of the upper portion 22 of the pintle 20 through the opening 42 in the upper surface 41 of the manifold 40. Thereby, we have formed an annular-shaped orifice, generally designated "H", of a size to permit and to maintain, without further (i.e., additional) adjustment, a desired quantity and rate of spray (or, more accurately, a rate of flow of spray) of a fluid through the annular-shaped orifice "H".

Lastly, we engage and torque the threaded nut 51 with the threaded lower end 21 of the pintle 20, until the nut 51 abuts the base surface 34 of the lower end 32 of the pintle support 30. Thereby, the nut 52 releasably locks the pintle 20 to the pintle support 30 and to the manifold 40 that is affixed to the pintle support 20.

As a result, our inventive adjustable pintle spray manifold assembly 10 is manufactured, assembled, and formed for use.

DESCRIPTION OF THE PREFERRED EMBODIMENT

Again with reference to FIG. 1, therein is shown, in a side elevation view, in simplified schematic form, and partially in cross section and partially fragmented, a preferred embodiment 10 of our inventive adjustable pintle spray manifold assembly.

As shown in FIG. 1, the preferred embodiment 10, and the inventive assembly, comprise: a pintle 20 having a lower portion 21, and an upper portion 22 with an end 23 thereat that is shaped in a converging-diverging configuration; a support 30 for the pintle 20, with the pintle support 30 surrounding, and removably connected to, the lower portion 21 of the pintle 20, and with the pintle support 30 having an upper portion 31 and a lower portion 32; a manifold 40 having an upper surface 41 with a first opening 42 therethrough, with that opening 42 sized and shaped to accept, and to permit the passage of, the configurated end 23 of the pintel 20, and with the manifold 40 also having a lower surface 43 with a second opening 44 therethrough, with that opening 44 sized to accept the upper portion 31 of the pintle support 30, with the manifold 40 disposed so as to surround the upper portion 22 of the pintle 20, and with the manifold 40 simultaneously disposed so as to surround the upper portion 31 of the pintle support 30, with that upper portion 31 protruding into, and affixed to, the second opening 44 of the manifold 40, thereby completely closing (i.e., sealing) the second opening 44; and, means, generally designated 50, for releasably locking the pintle 20 to the pintle support 30 and also to the manifold 40 that is affixed to the pintle support 30.

It is to be noted that, as a matter of preference, and not as a limitation: the lower portion 21 of the pintle 20 is threaded 21; the pintle support 30 has a passageway 33 extending through the upper portion 31 and the lower portion 32, with the passageway threaded to accept, engage with, and releasably hold the threaded lower portion 21 of the pintle 20; the upper portion 31 of the pintle support 30 is affixed by brazing or by welding to the second opening 44 of the manifold 40, as indicated by the representative annular-like weld "W"; and, the means 50 for releasably locking the pintle 20 to the pintle support 30 and to the manifold 40 affixed to the pintle support 30, includes threading 24 on the lower portion 21 of the pintle 20, and a complimentarily threaded nut 51 that is dimensioned and configurated to accept, engage with, and releasably lock the nut 51 to the threaded lower portion 21 of the pintle 20.

Figure 2:
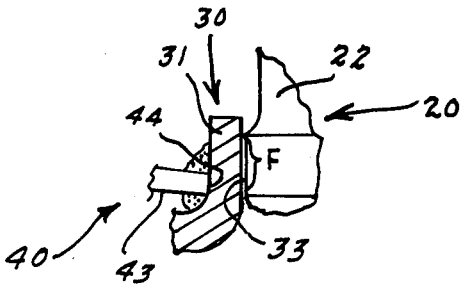
FIG. 2 is a side elevation view, in simplified schematic form, in detail, and not to scale of a selected portion of the preferred embodiment, as shown encircled in FIG. 1.

With reference to FIG. 2, therein is shown in a side elevation view, in simplified schematic form, in detail, and not to scale, a selected portion of the preferred embodiment, as shown encircled and generally designated 2 in FIG. 1 for easy identification and easy reference.

Easily seen are fragments of: the upper portion 22 of pintle 20; the upper portion 31 of pintle support 30, together with the passageway 33 in and of the pintle support 30; and, the opening 44 in the lower surface 43 of the manifold 40.

Also easily seen is the abutting annular area, generally designated "F", FIGS. 1 and 2, that is formed by the abutting surfaces of pintle 20 and of pintle support 30. That abutting annular area "F" constitutes, and is, a tight (i.e., sealing) fit.

MANNER OF USE OF THE PREFERRED EMBODIMENT

The manner of use (and of operation) of our inventive adjustable pintle spray manifold assembly 10 can be ascertained very easily by a person of ordinary skill in the art from the foregoing description, coupled with reference to the Figures of the drawing.

For others, it is sufficient to say in explanation that the pintle 20 is moved upward, so that the converging-diverging end 23 protrudes sufficiently through opening 42, in upper surface 41 of manifold 40, to form an orifice "H" of sufficient size to permit the flow of the desired quantity and at the desired rate of flow of fluid therethrough. Then, the pintle 20 and the other components are locked in that relative position by tightening nut 50. No further adjustment of the orifice "H" is necessary. It is to be noted that the configuration of the end 23 of pintle 20 is such that: when end 23 protrudes through opening 42 and the fluid is flowing therebetween, a spray results; and, when end 23 is lowered and abuts with opening 42, the opening 42 is closed and sealed and no flow occurs.

CONCLUSION

It is abundantly clear from all of the foregoing, and from the Figures of the drawing, that the stated and desired objects, and other related objects, of our invention have been achieved.

It is to be noted that, although there have been described the fundamental and unique features of our inventive adjustable pintle spray manifold, as applied to a particular preferred embodiment, other embodiments, adaptations, additions, omissions, and the like will occur to, and can be made by, those of ordinary skill in the art, without departing from the spirit of the inventive assembly. For example: (a) the tight fit "F", FIGS. 1 and 2, may be a sheared silver fit; and, (b) pintle locking may be provided by using a pintle with a bolt head, and then using a tab washer element to lock the pintle in place after adjustment of orifice "H", instead of using nut 51.

Additionally, because of my teaching, it will occur to others of ordinary skill in the art that, in appropriate particular circumstances, the number and/or the sequence of the basic and fundamental steps of my inventive method can be varied (e.g., the fourth and fifth steps of the method may be interchanged, so that the step of forming an opening 42 in and through the upper surface 41 of the manifold 40 may be performed before the step of threading the passageway 33 of the pintle support 30), within the teaching of my method, while attaining nevertheless the same desired ultimate result.

What is claimed is:

1. An adjustable pintle spray manifold assembly, comprising:

a. a pintle having a lower portion, and an upper portion with an end shaped in a converging-diverging configuration;

b. a support for said pintle, with said pintle support surrounding, and removably connected to, the lower portion of said pintle, and with said pintle support having an upper portion and a lower portion;

c. a manifold having an upper surface with a first opening therethrough sized and shaped to accept, and to permit the passage of, the configurated end of the upper portion of the pintle, and a lower surface with a second opening therethrough sized to accept the upper portion of the pintle support, with said manifold disposed surrounding the upper portion of said pintle support protruding into, and affixed to, the second opening of said manifold, thereby completely closing the second opening;

d. and, means for releasably locking said pintle to said pintle support and also to said manifold that is affixed to said pintle support;

whereby said pintle may be moved upwardly, so that the configurated end of the upper portion of the pintle protrudes through the first opening in the upper surface of said manifold, thereby forming a variable sized annular-shaped orifice between the first opening in the manifold and the configurated end of the pintle, whereby a desired quantity, and rate of spray of a fluid through the variable sized annular-shaped orifice may be easily attained and maintainted, without further adjustment, after said pintle end has once been adjusted.

2. An adjustable pintle spray manifold, as set forth in claim 1, wherein:

a. the lower portion of said pintle is threaded;

b. said pintle support has a passageway extending through the upper portion and the lower portion, with the passageway threaded to accept, engage with, and releasably hold the threaded lower portion of said pintle.

3. An adjustable pintle spray manifold assembly, as set forth in claim 1, wherein the upper portion of said pintle support is affixed by brazing to the second opening of the manifold.

4. An adjustable pintle spray manifold assembly, as set forth in claim 1, wherein the upper portion of said pintle support is affixed by welding to the second opening of the manifold.

5. An adjustable pintle spray manifold assembly, as set forth in claim 1, wherein said means for releasably locking said pintle to said pintle support and to said manifold that is affixed to said pintle support, includes threading on the lower portion of said pintle and a complimentary threaded nut that is dimensioned and configurated to accept, engage with, and releasably lock said nut to said threaded lower portion of said pintle.

6. The method of manufacturing and assembling an adjustable pintle spray manifold assembly, wherein said assembly includes: a manifold having an upper surface and a lower surface; a pintle having an upper portion with an end shaped in a converging-diverging configuration, and a threaded lower portion; a pintle support having an upper portion, a lower portion with a base surface, and a passageway extending through the upper portion, the lower portion, and the base surface of said pintle support; and, a nut complimentary threaded to accept, engage with, and releasably hold the threaded lower portion of said pintle; comprising the steps of:

a. forming an opening in and through the lower surface of the manifold;

b. affixing the manifold, at the opening, to the upper portion of the pintle support, thereby completely closing this opening in the manifold and intergrating the manifold and the pintle support;

c. heat treating the affixed and integrated manifold and pinle support, thereby relieving any stresses in the affixed and integrated manifold and pintle support;

d. threading the passageway of the pintle support to accept, engage with, and releasably hold the threaded lower portion of the pintle;

e. forming an opening in and through the upper surface of the manifold;

f. inserting and engaging the pintle into the threaded passageway of the pintle support, whereby the upper portion of the pintle is disposed in the manifold, with the configurated end of the upper portion of the pintle in the opening in the upper surface of the manifold, and with part of the threaded lower portion of the pintle extending beyond and below the base surface of the pintle support;

g. adjusting the upward position of the configurated end of the upper portion of the pintle through the opening in the upper surface of the manifold, thereby forming an annular-shaped orifice of a size to permit and maintain without further adjustment, a desired quantity and rate of spray of a fluid through said annular-shaped orifice;

h. and, engaging and torquering the threaded nut with the threaded lower end of the pintle, whereby the nut abuts the base surface of the lower end of the pintle support and releasably locks the pintle to the pintle support and to the manifold affixed to the pintle support.

* * * * *